US006689489B2

(12) United States Patent
McDevitt

(10) Patent No.: US 6,689,489 B2
(45) Date of Patent: Feb. 10, 2004

(54) COMPOSITION FOR CONTROLLING SPANGLE SIZE, A COATED STEEL PRODUCT, AND A COATING METHOD

(75) Inventor: Erin T. McDevitt, Bethlehem, PA (US)

(73) Assignee: ISG Technologies, Inc., Richfield, OH (US)

( * ) Notice: Subject to any disclaimer, the term of this patent is extended or adjusted under 35 U.S.C. 154(b) by 0 days.

(21) Appl. No.: 10/256,643

(22) Filed: Sep. 27, 2002

(65) Prior Publication Data

US 2003/0113575 A1 Jun. 19, 2003

Related U.S. Application Data

(63) Continuation-in-part of application No. 09/978,794, filed on Oct. 18, 2001, now Pat. No. 6,468,674, which is a continuation-in-part of application No. 09/414,766, filed on Oct. 7, 1999, now abandoned.

(51) Int. Cl.[7] ..... B32B 15/00; B05D 1/18

(52) U.S. Cl. ..... 428/653; 427/320; 427/431; 427/433; 427/436; 428/659; 428/441.1; 428/939

(58) Field of Search ..... 428/653, 659, 428/411.1, 939; 427/320, 431, 433, 436

(56) References Cited

U.S. PATENT DOCUMENTS

| | | | |
|---|---|---|---|
| 3,112,212 | A | 11/1963 | Holowaty et al. |
| 3,150,937 | A | 9/1964 | Link et al. |
| 4,287,008 | A | 9/1981 | Torok et al. |
| 4,401,727 | A | 8/1983 | Berke et al. |
| 4,510,183 | A | 4/1985 | Akyol |
| 4,873,153 | A | 10/1989 | Miller |
| 6,235,410 | B1 | 5/2001 | Komatsu et al. |
| 6,440,582 | B1 | 8/2002 | McDevitt et al. |

FOREIGN PATENT DOCUMENTS

| | | |
|---|---|---|
| EP | 0 174 019 A1 | 3/1986 |
| GB | 1333 957 | 10/1973 |
| GB | 2 171713 A | 9/1986 |
| WO | WO 01/27343 A1 | 4/2001 |

OTHER PUBLICATIONS

Metallurgical Transactions, vol. 2, Feb. 1971 "Grain Refinement in Aluminum Alloyed with Titanium and Boron," J. A. Marcantonio, et al., pp. 465–471.

Metallurgical Transactions, vol. 18A, Apr. 1987, "The Role of Boron inthe Grain Refinment of Aluminum with Titanium," M. M. Guzowski, et al., pp. 603–619.

Metals Technology, Jan. 1982, "Grain Refinment of Aluminum," L. Arnberg, et al., pp. 1–6.

Metallurgical Transactions, vol. 7b, Jun. 1976, "Factors Affecting the Grain–Refinement of Aluminum Using Titanium and Boron," G. P. Jones, et al., pp. 223–234.

Journal of the Institute of Metals, 1951–52, vol. 80, "The Grain Refinement of Aluminum Alloy Castings by Additions of Titanium and Boron," A. Cibula, et al., pp. 1–16 (no month given).

Transactions Aime, Dec. 1951, Journal of Metals, 1143, "Mechanism of Grain Refinement in Aluminum Alloys," F.A. Crossley, et al., pp. 1143–1148.

International Materials Reviews, vol. 34,No. 5, Grain Refining of Aluminum and its Alloys Using Inoculants, pp 247–260, D. G. McCartney (1989) (no month given).

*Primary Examiner*—Robert R. Koehler
(74) *Attorney, Agent, or Firm*—Harold I. Masteller, Jr.

(57) ABSTRACT

A method of coating of steel products such as plate and sheet using an aluminum-zinc coating alloy includes modifying the coating bath with a particulate compound constituent in effective amounts to control the spangle facet size of the coated product, improve tension bend rust stain performance, and improve coated product paintability. Constituents include borides such as titanium boride and aluminum borides, carbides such as titanium carbide, and aluminides such as titanium aluminide. The method produces a coated steel product that does not require temper rolling for painting.

15 Claims, 7 Drawing Sheets

MIN. SPANGLE GALVALUME – 0.04% Ti, 0.008% B

NORMAL GALVALUME – NO $TiB_2$ ADDITION

MIN. SPANGLE GALVALUME – 0.02% Ti, 0.004% B

MIN. SPANGLE GALVALUME – 0.04% Ti, 0.008% B

NORMAL GALVALUME – NO Ti ADDITION

MIN. SPANGLE GALVALUME – 0.02% Ti, 0% B

MIN. SPANGLE GALVALUME – 0.04% Ti, 0% B

NORMAL GALVALUME – NO TIC ADDITION

MIN. SPANGLE GALVALUME – 0.02% Ti, 0.001% C

MIN. SPANGLE GALVALUME – 0.2% Ti, 0.01% C

NORMAL GALVALUME – NO $AlB_{12}$ /$AlB_2$ ADDITION

MIN. SPANGLE GALVALUME – 0% Ti, 0.03% B

MIN. SPANGLE GALVALUME – 0% Ti, 0.06% B

COMPOSITION FOR CONTROLLING SPANGLE SIZE, A COATED STEEL PRODUCT, AND A COATING METHOD

This is a continuation-in-part of application Ser. No. 09/978,794, filed Oct. 18, 2001, now U.S. Pat. No. 6,468, 674 B1, issued Oct. 22, 2002 , which is a continuation of application Ser. No. 09/414,766 filed Oct. 7, 1999 now abandoned.

FIELD OF THE INVENTION

The present invention is directed to a coating composition, a coated steel product, and a method of making, and in particular, to an aluminum-zinc coating composition employing effective amounts of a particulate compound constituent to enhance tension bend rust stain performance and the appearance of the sheet when painted and reduce spangle facet size.

BACKGROUND ART

The coating of steel components with aluminum-based coating alloys, commonly referred to a hot dip coating, is well known in the prior art. One particular type of coating is trademarked as Galvalume®, which is owned by BIEC International, Inc., and is representative of an aluminum-zinc coating alloy.

These materials are advantageous as building materials, particularly wall and roof construction due to their corrosion resistance, durability, heat reflection, and paintability. Typically, these materials are manufactured by passing a steel product such as a sheet or plate through a bath of a melted alloy coating composition comprising aluminum, zinc, and silicon. The amount of coating applied to the steel products is controlled by wiping, and then the products are cooled. One characteristic of the coating applied to the steel product is its grain size or spangle facet size.

U.S. Pat. No. 3,343,930 to Borzillo et al., U.S. Pat. No. 5,049,202 to Willis et al. and U.S. Pat. No. 5,789,089 to Maki et al. disclose methods and techniques for the manufacture of steel sheets coated with these aluminum-zinc alloys. The three references are herein incorporated by reference in their entirety.

European Patent Application No. 0 905270 A2 to Komatsu et al. discloses another coating process utilizing zinc, aluminum, and magnesium. This application is directed at solving the corrosion problems associated with baths containing magnesium as an alloying element. Further, it is disclosed that the undesirable stripe pattern occurring in magnesium-containing baths does not occur in baths without magnesium.

U.S. Pat. No. 5,571,566 to Cho discloses another method of manufacturing coated steel sheet using an aluminum-zinc-silicon alloy. The object of the Cho patent is to provide a more efficient production method for manufacturing coated steel sheet. Cho meets this object by uniformly minimizing the size of spangles by introducing a large number of spangle particles into the coating, which limits subsequent growth of the spangles because these particles interfere with their respective growth resulting in a smaller spangle facet size. The seed effect is achieved by using titanium as part of the molten coating composition.

A similar disclosure with respect to the use of titanium in coating baths to minimize spangle facet size is disclosed in an article entitled "Minimization of Galvalume Spangle facet size By Titanium Addition To Coating Bath", by Cho, presented for the INTERZAC 94 Conference in Canada in 1994. In this article, the author indicates that elements such as titanium, boron, and chromium produce finer spangles in a Galvalume coating, such a disclosure consisted with the disclosure of the Cho patent.

Notwithstanding the improvements suggested by Cho, presently used coated steel products still have disadvantages. One disadvantage is that, when the coated steel product is to be painted, a temper rolling is required to flatten the product in preparation for painting. Another problem is cracking when the product is a sheet and is bent. When this sheet product is bent, the coating can crack, the crack exposing the steel to the environment and premature corrosion. With presently available coated steel sheets, large cracks can form, thereby compromising the corrosion resistance of the sheet product.

In light of the deficiencies in the prior art, a need has developed to provide an aluminum-zinc coated steel product with improved bending performance, reduced spangle facet size, and improved painted surface appearance. The present invention solves this need by providing a method of coating a steel product, a coating composition and a coated steel article which, when experiencing surface cracking during bending, is still corrosion resistant and does not require temper rolling when the coated steel product is painted. The coating composition is modified with one or more particulate compound constituents such as titanium boride, aluminum boride and the like.

SUMMARY OF THE INVENTION

Accordingly, it is a first object of the present invention to provide an improved hot dip coating composition for steel products.

Another object of the present invention is a method of coating a steel product using a modified aluminum-zinc coating alloy.

Still further objects of the present invention are to provide a coated steel product with enhanced tension bend rust stain performance and painted appearance.

One other object of the present invention is a coated steel article employing a modified coating alloy composition.

Yet another object of the invention is a method of coating and then painting a steel product, whereby the coated steel product does not require temper rolling before painting.

One other object of the present invention is a coated steel article having a uniform, consistent spangle size of between about 400 to 500 microns.

Other objects and advantages of the present invention will become apparent as a description thereof proceeds.

In satisfaction of the foregoing objects and advantages, the present invention is an improvement in the art of hot dip coating of steel products using an aluminum-zinc coating alloy. The composition of the aluminum-zinc alloy is modified by adding an effective amount of one or more of a particulate compound constituent selected from the group consisting of boride compounds having one of titanium and aluminum, aluminide compounds containing titanium and iron, and carbide compounds containing titanium, vanadium, tungsten, and iron. Preferably, the constituent is one of TiC, $TiB_2$, $AlB_2$, $AlB_{12}$, and $TiAl_3$.

The constituent can be prepared in various ways as part of the modification step, e.g., as part of a precursor or master alloy ingot or bath containing principally aluminum, the master alloy then added to an aluminum-zinc bath in the necessary proportions to arrive at a final bath composition suitable for coating and providing the benefits of the invention as a result of the modifier constituent. The constituent can be added to the master alloy as particulate compounds or can be formed in-situ in the master alloy to add to the actual coating bath.

More particularly, the composition of the coating bath can be modified by; (1) directly adding the particles (as a powder) to the coating bath or a pre-melt pot which feeds the coating bath; (2) adding an ingot than contains the required particles; the ingot may be aluminum with particles, zinc with particles, a zinc-aluminum alloy with particles, etc.; the ingot may be added to a main coating pot or a pre-melt pot; (3) adding molten bath containing the required particles, wherein the liquid may be aluminum with particles, zinc with particles, a zinc-aluminum alloy with particles, etc.; (4) in-situ reaction in the main pot or pre-melt pot, for example by the reaction of elemental species, such as titanium and boron in an aluminum feed melt, or the reaction of salts on the feed melt pot to produce particles.

The particle size of the constituent in the coating bath can vary but preferably ranges from about 0.01 and 25 microns. When practicing the invention, a spangle facet size of a coated product can range as low as 0.05 mm and up to 2.0 mm.

The effective amount of the constituent is considered to be that amount which reduces the spangle facet size of the coated product, causes an increase in the number of cracks while maintaining a smaller crack size than conventional aluminum-zinc coated products, and does not require temper rolling when painting. An overall weight percentage range of the constituent, boride, carbide, or aluminide, based on the alloy bath is believed to be between about 0.0005 and 3.5%. When the constituent is a boride, a preferred weight percentage of the constituent as part of the coating bath can range between about 0.001 and 0.5%. When the constituent is a carbide, a preferred weight percentage can range between about 0.0005 and 0.01%.

The invention also provides a coated steel article employing a coating containing the particulate compound constituent as well as the coating composition as applied to the steel product. The product is preferably a steel sheet or plate for construction purposes.

BRIEF DESCRIPTION OF THE DRAWINGS

Reference is now made to the drawings of the invention wherein.

DESCRIPTION OF THE PREFERRED EMBODIMENTS

Figure 1:
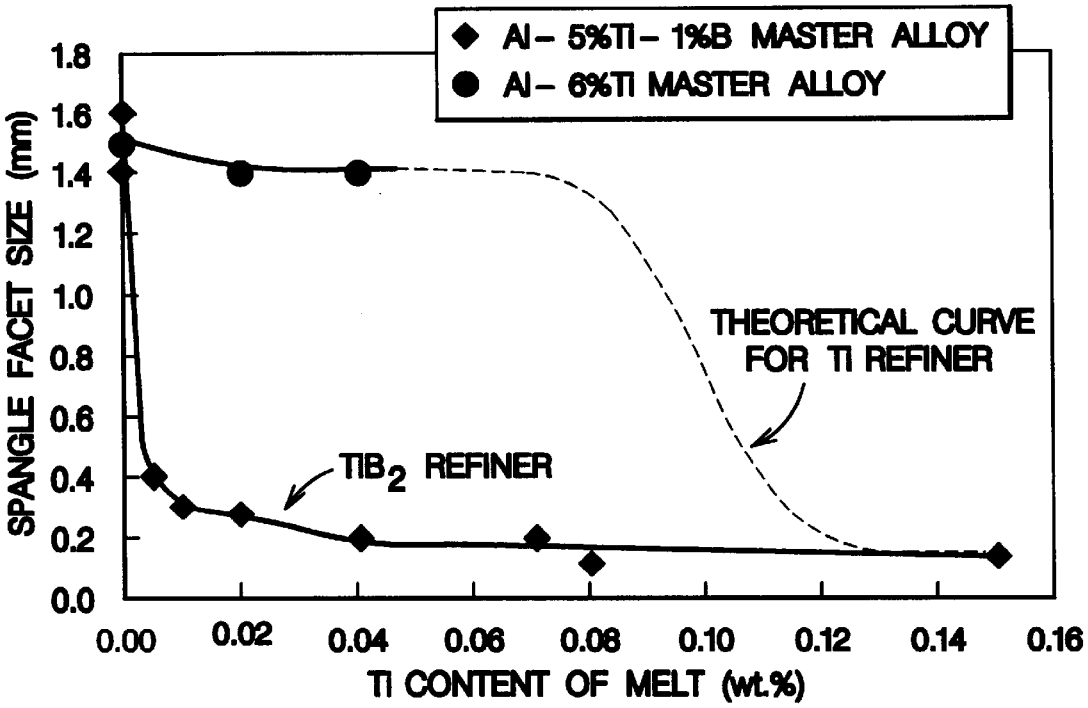
FIG. 1 is a graph comparing the use of titanium boride and titanium as melt additives for hot dip coating in terms of spangle facet size and titanium content.

The present invention advances the art of hot dipping or coating steel products, particularly plate and sheet products, using an aluminum-zinc molten alloy bath, e.g., a Galvalume bath. According to the invention, the coating bath is modified with particulate compound constituents to reduce the spangle facet size of the coated steel product. With the addition of the particulate constituents, improvements may also be realized in the performance of the coated steel product in terms of tension bend rust staining. Tension bend rust staining is a discrete pattern of cosmetic red rust running along the rib of a prepainted, roll formed, building panel caused by cracking of the metallic coating and paint.

The surface of the coated steel product also yields a painted appearance that is superior to conventional Galvalume product. This is believed to allow for the production of smooth coated steel sheet product without the need for temper rolling. Eliminating the extra processing step of temper rolling also reduces energy consumption, eliminates possible waste streams associated with temper rolling, and simplifies the production process.

In its broadest embodiments, the invention entails a novel composition for a coating of steel product, a method of making such a coating, and the article made from such method.

When coating steel products with an aluminum-zinc coating bath, the processing steps of forming the bath to the desired composition and passing the steel product to be coated through the bath are well-known. As a result, a further description of the prior art methods and apparatus to accomplish this conventional coating is not deemed necessary for understanding of the invention.

The composition of the prior art aluminum-zinc alloy baths is well-known as discussed in the Borzillo et al. and Cho patents, and the Cho publication noted above. Generally, this bath comprises about 55% aluminum, a level of silicon, generally about 1.6% by weight, and the balance zinc. Other variations in the composition are within the scope of the invention as would be conventionally known to those of ordinary skill in the art.

According to the invention, the aluminum-zinc molten bath is modified with a particulate compound constituent to achieve improvements in terms of reduced spangle facet size, improved surface finish, reduction in crack size, and potential improvements in tension bend rust staining. The particulate compound constituent can be a boride, carbide, or aluminide. Preferably, the boride compounds include titanium boride ($TiB_2$), and aluminum boride ($AlB_2$ and $AlB_{12}$). The particulate compound constituent as a carbide can be titanium carbide, vanadium carbide, tungsten carbide, and iron carbide, and as an aluminide, titanium aluminide ($TiAl_3$) and iron aluminide. The level of the particulate compound constituent is set as an amount to effectively reduce the spangle facet size over that of conventional coatings, with or without elemental titanium. While the effective amount may vary depending on which compound is selected, it is anticipated that the amount would range from about 0.0005% to about 3.5% by weight of the carbon, boron, or aluminide of the composition of the coating bath. For carbon, a more preferred range is between about 0.005% and 0.10% by weight of the bath. In terms of titanium concentration, a titanium boride containing coating melt bath could have a titanium concentration between about 0.001% and 0.1% by weight of the bath. For the boride compound, the boron weight percentage in the bath can range from 0.001% to 0.5% by weight.

Table 1 shows broad claimed ranges for the particle additions if only a single type of particle is added:

TABLE 1

| | Coating Bath Composition (wt. %) Nominally 55% Al-1.6% Si-bal. Zn | | | Wt. % Particle |
|---|---|---|---|---|
| | Ti | B | C | in the melt |
| $TiB_2$ | 0.002–1.0 | 0.001–0.5 | — | 0.007–3.5 |
| $AlB_2$ | — | 0.001–0.5 | — | 0.010–5.0 |
| $AlB_{12}$ | — | 0.001–0.5 | — | 0.005–2.5 |
| TiC | 0.0019–1.9 | — | 0.0005–0.5 | 0.0025–2.5 |

For example, for 100 g of melt, the amount of $TiB_2$ particle addition should be 0.007–3.5 grams.

The values in Table 1 assume stoichiometric additions. Excess Ti (in the case of TiC or $TiB_2$) is permissible, but not necessary.

Table 2 shows preferred ranges or optimal ranges for the particle additions:

TABLE 2

| Particle | Coating Bath Composition (wt. %) nominally 55% Al-1.6% Si-bal. Zn | | | wt. % Particles in |
|---|---|---|---|---|
| Type | Ti | B | C | the melt |
| $TiB_2$ | 0.01–0.05 | 0.002–0.1 | — | 0.014–0.7 |
| $AlB_2$ | — | 0.02–0.05 | — | 0.2–0.5 |
| $AlB_{12}$ | — | 0.02–0.05 | — | 0.2–0.5 |
| TiC | 0.011–0.38 | — | 0.003–0.1 | 0.015–0.5 |

The particle size of the particulate constituent should range between about 0.01 and about 25 microns. By coating a steel product using the inventive method, spangle facet sizes are produced which range from as low as 0.05 up to 2.0 mm.

The molten bath used to coat this steel product containing the modified aluminum-zinc alloy composition can be prepared in a number of ways. In one method, a master alloy of aluminum is prepared and is modified with the particulate compound constituent. This bath is then added to an aluminum-zinc coating bath, the proportions of the two baths calculated to arrive at a target bath composition containing the effective amount of the particulate compound constituent. The modified alloy bath would still track the conventional weight percentages of the aluminum, zinc and silicon for these types of coating baths, e.g., about 55% aluminum, 1–2% silicon, the balance zinc, since the effective amount of the particular compound constituent is a relatively low weight percentage of the overall bath amount. Methods for making master alloys are taught in U.S. Pat. No. 5,415,708 to Young et al. and U.S. Pat. No. 3,785,807, both herein incorporated by reference in their entirety.

Secondly, the master alloy containing the particles could be added to the coating bath in the form of a solid ingot. The ingot may be primarily Al, primarily Zn, or an alloy containing Zn, Al, and/or Si along with the spangle refining particles.

Alternatively, the particulate compound constituents could be added directly to the aluminum-zinc bath prior to coating a steel product.

When using aluminum boride as a bath modifier, boron particles can be added to an aluminum master alloy to facilitate incorporation of the particles into the melt and improve even distribution of the particles throughout the melt. Alternatively, aluminum boride particles can be added to the aluminum-zinc bath in the appropriate amounts.

When producing an aluminum master alloy with the particulate compound constituents such as titanium boride, some excess titanium may exist in the bath. This excess may range from 0.01% to 10% relative to the total mass of boron added. In terms of the stoichiometry, titanium additions in excess of one mole of titanium for 2 moles of boron may range from 0.002 to 4.5 excess moles. It is not believed that the excess titanium, whether present through the use of titanium boride or another titanium-containing compound such as titanium carbide or the like, is necessary to obtain the spangle refinement associated with the invention.

In preparing the alloy bath for coating, the particulate compound constituent can be introduced as a powder or formed in the bath itself. For example, titanium boride powders could be added to an aluminum bath in the appropriate weight percentages. Alternatively, elemental titanium and boron could be added to an aluminum melt and heated at sufficiently high temperatures to form titanium boride particles therein. It is preferred that the compound particles be added to the master alloy since this processing is much more effective in terms of energy consumption. Similar processing techniques can be employed for the carbides and aluminides.

It is believed that the presence of titanium and boron in a coating bath alone will not produce the grain refining benefits demonstrated above as compared to adding a compound particulate such as titanium boride. It has been reported that in aluminum casting, the separate addition of titanium and boron to an aluminum melt did not produce titanium boride particles when added at temperatures below 1000° C. (1832° F.). Instead, the titanium reacted with the aluminum to form $TiAl_3$ particles. Since the coating process is generally conducted at much lower temperatures, i.e., 593° C. (1100° F.), adding titanium and boron in elemental form to an Al—Zn coating bath would produce similar behavior. In addition, the kinetics of titanium and boron dissolution will be very slow at the low temperatures associated with the coating method. Thus, when forming the titanium boride in the bath itself, it is necessary to go beyond conventional melting parameters to achieve the necessary particulate for use in the invention.

The inventive coating method produces a coated article, wherein the coating has a coating composition including the added particulate compound constituent described above. The coated product can then be painted as is known in the art without the need for temper rolling or skin passing.

While titanium and aluminum borides, and titanium aluminide have been exemplified as spangle refiners, other carbides, such as vanadium carbide, tungsten carbide, iron carbide, and aluminum compounds such as iron aluminide, are also believed to be within the scope of the invention.

In order to demonstrate the unexpected benefits associated with the invention, studies were done comparing coated steel products using an aluminum titanium master alloy and an aluminum titanium boride master alloy. These master alloys were added to the aluminum-zinc coating alloys to form a coating bath for the steel to be tested. FIG. 1 compares two curves based on the master alloys noted above, the curves relating spangle facet size and the titanium content of the melt in weight percent. As is evident from FIG. 1, the use of a master alloy with titanium boride significantly refines the spangle facet size, particularly at much lower additional levels of titanium. For example, at a titanium content of 0.02% by weight, the reported spangle facet size is about 0.3 mm as compared to a spangle facet size of 1.4 mm when only titanium is used. Thus, not only does the boride modifier reduce spangle facet size, it also reduces cost by lowering the amount of titanium needed.

Figure 2:
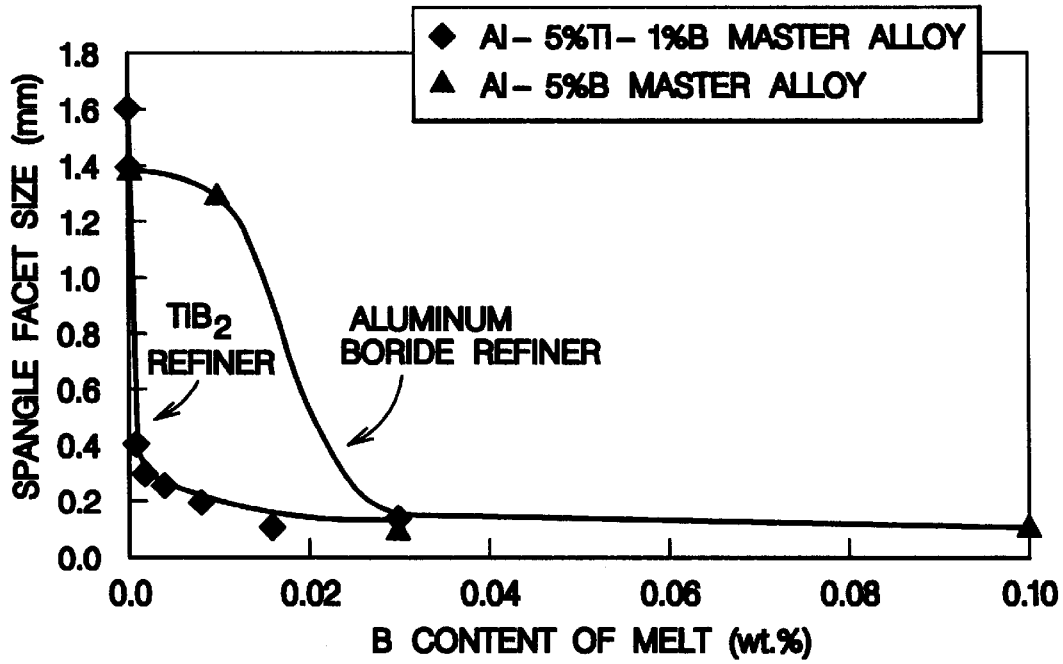
FIG. 2 is a graph comparing the use of titanium boride and aluminum boride as melt additives for hot dip coating in terms of spangle facet size and boron content.

FIG. 2 shows a similar comparison between a master alloy containing titanium boride and a master alloy of aluminum and boron. FIG. 2 shows that the titanium boride refiner achieves a smaller spangle facet size for boron levels up to about 0.03% by weight, when compared to a master alloy of just aluminum and boron. However, when comparing FIGS. 1 and 2, the use of an aluminum boride particulate compound constituent to reduce spangle facet size is more effective than just titanium.

Figure 3:
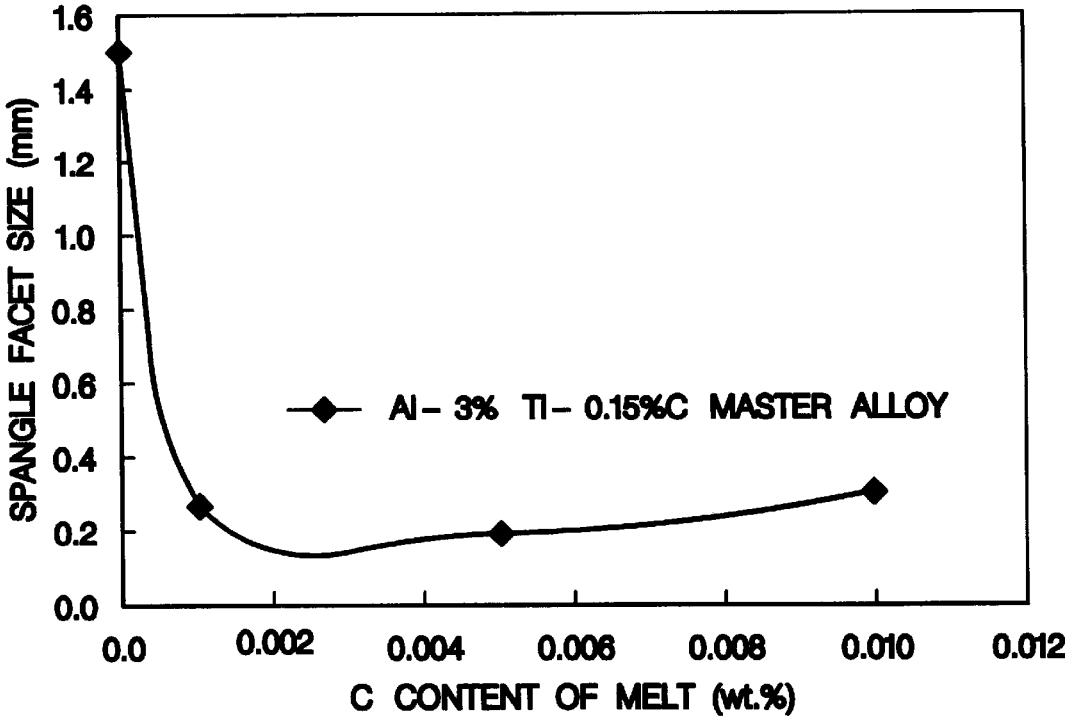
FIG. 3 is a graph comparing the use of titanium carbide as a melt additive for hot dip coating in terms of spangle facet size and carbon content.

FIG. 3 shows a graph exhibiting behavior for a coating composition modified with titanium carbide that is similar to the $TiB_2$-modified coating of FIG. 1

Figure 4:
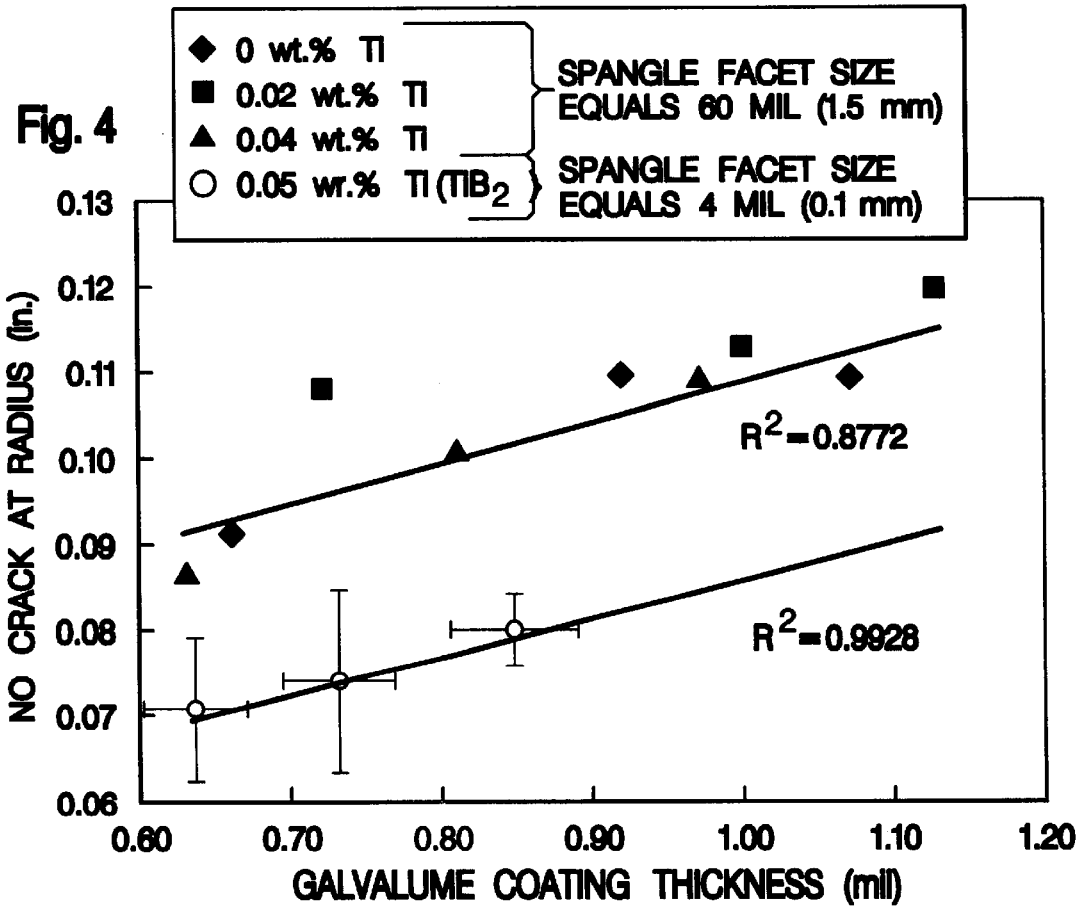
FIG. 4 is a graph showing bend test result comparisons for coating compositions modified with titanium and titanium boride.

Besides minimizing the spangle facet size, the use of the particulate compound constituent according to the invention also allows the coated steel product to tolerate more severe bending without cracking. Referring now to FIG. 4, a comparison is made between products coated with a coating bath alloy composition employing just titanium and one employing 0.05% weight titanium boride. The spangle facet size is decreased from 1.5 mm to 0.1 mm when titanium boride is used. When the coated products are subjected to conical bend tests, the coating thickness of the product was plotted against the radius at which no crack occurred. Conical bend tests are tests that generally follow ASTM D522-93a. The product employing titanium boride as a particulate compound constituent in the coating bath decreased the no-crack radius by 23%.

Figure 5:
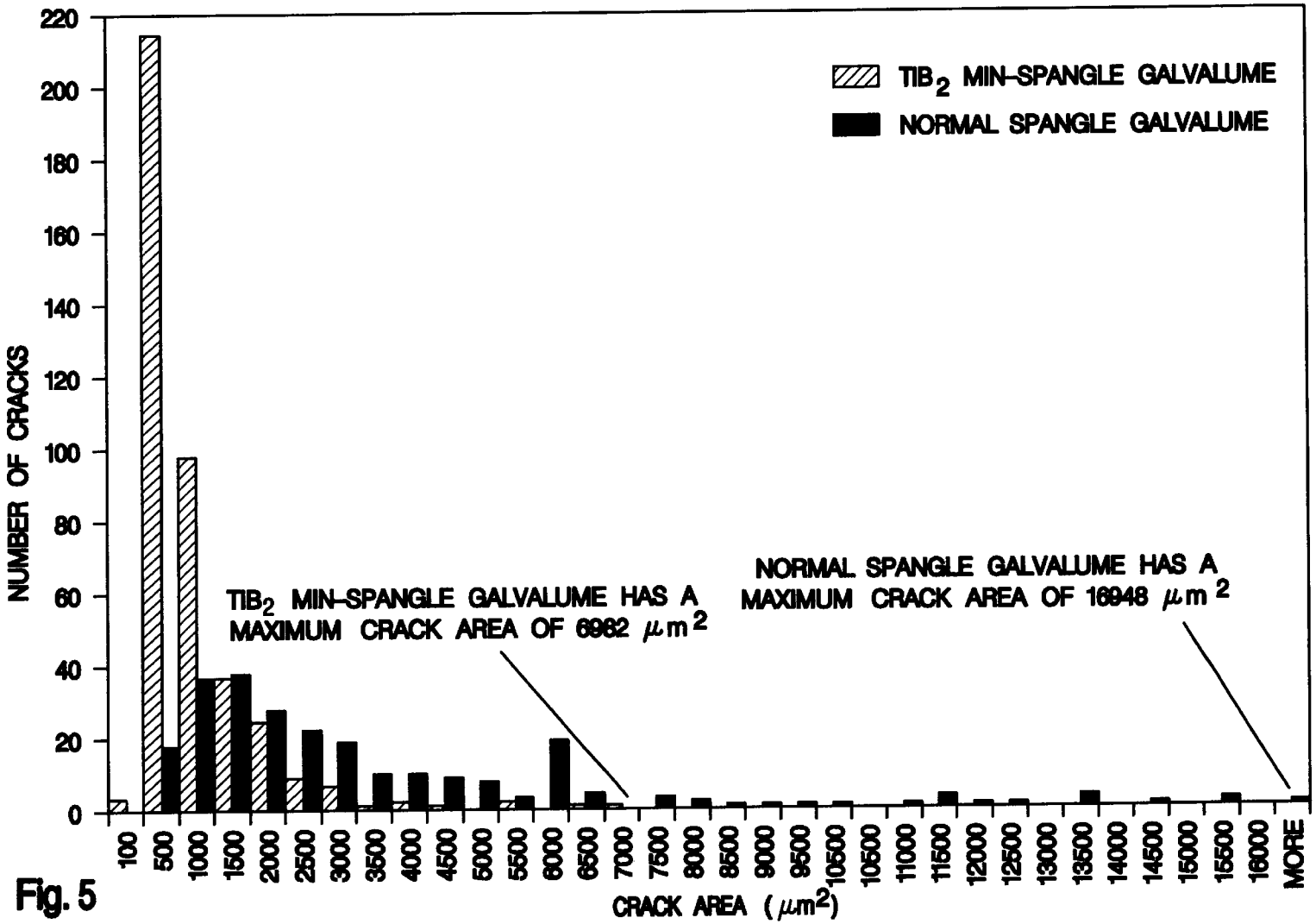
FIG. 5 is a graph comparing crack area and number of cracks for a coating composition containing titanium boride and a conventional coated steel product.

Another unexpected result associated with the invention is the formation of more numerous but small cracks during bending as compared to conventional aluminum-zinc alloy coatings of sheet product. Referring to FIG. 5, it can be seen that the titanium boride-modified aluminum zinc coated steel product has a significantly higher number of cracks than conventional aluminum zinc. However, the conventional product has a significantly increased crack area as compared to the titanium boride modified product. The smaller but more uniformly distributed cracks of the invention promote crack bridging by paint films. This bridging then facilitates choking off of corrosion products quicker than the larger cracks associated with conventional aluminum zinc coatings would. Thus, the titanium boride-coated product would exhibit improved corrosion resistance over prior art products.

The graph of FIG. 5 was based on bending a coated sample on a 1/16" cylindrical bend. The size of the cracks were measured after bending and a 19.71 square millimeter surface portion was examined for the number of cracks and their size. The maximum crack size in the inventive product is less than half (41%) of the size of the maximum crack size in the conventional product. This behavior is beneficial in preventing or reducing tension bend rust staining, where it is thought that the size of the worst cracks are what control the tension bend rust staining behavior of a coating.

Another equally important attribute of the invention is the surface quality of the inventive coated steel product and its improved suitability for painting. Table 3 shows profilometry results for a number of conventionally aluminum-zinc coated products and products coated with the titanium boride modified aluminum zinc alloy. The conventional product is noted as a Galvalume coating in Table 3. This table shows that the surface waviness ($W_{ca}$) of the coated product of the invention is substantially lower than the as coated and temper rolled conventional Galvalume product. The average waviness of the as coated and titanium boride-modified sheet is 67% better than the as coated regular Galvalume product produced under identical conditions. The minimal spangle Galvalume waviness with the product of the invention is 50% better than the larger spangle mill produced temper rolled Galvalume. The titanium boride-modified minimum spangle Galvalume does not require temper rolling to reduce waviness, and is ideal for high speed coil coating applications. The appearance of the painted product is superior to large spangled as—coated and skin—passed Galvalume.

TABLE 3

Profilometry Results For A Number Of Conventional Galvalume Coatings And $TiB_2$, Modified Minimum Spangle Galvalume

| Coating Process/Line | Surface ID/ Condition | $R_a$ (μin) | $R_t$ (μin) | $W_{ca}$ (μin) | PC (ppi) |
|---|---|---|---|---|---|
| Galvalume w/$TiB_2$ Master Alloy Pilot Line | As-coated | 24.3 | 273.4 | 15.9 | 167 |
| Conventional Galvalume | As-coated | 16.7 | 196.1 | 48.4 | 58.0 |
| Average Mill Produced Galvalume | As-coated | 21.6 | 271.2 | 61.3 | 97.5 |
| | Temper Rolled | 47.3 | 354.9 | 39.6 | 153.5 |

Figure 6A:
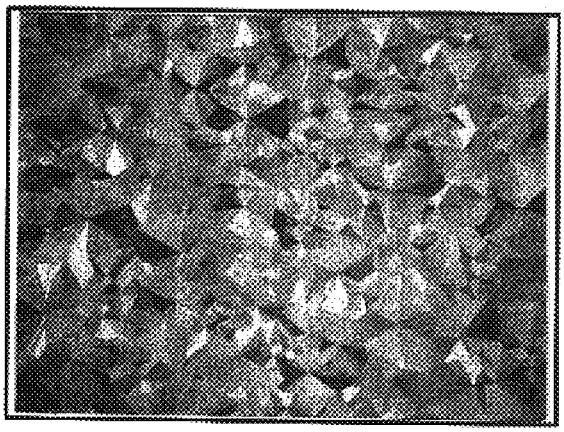
FIGS. 6*a*–6*c* are photomicrographs showing spangle facet size for a conventionally coated product and a $TiB_2$-modified product.
Figure 6B:
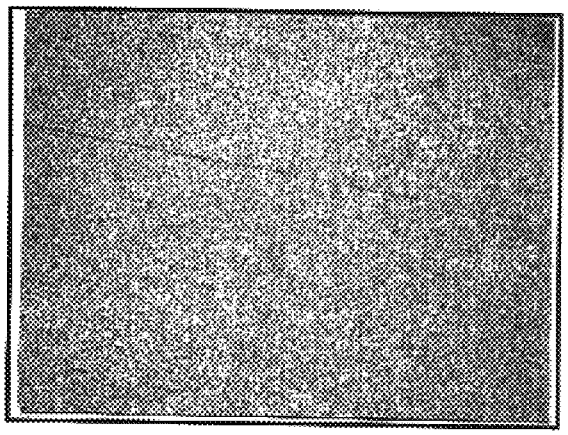
Figure 6C:
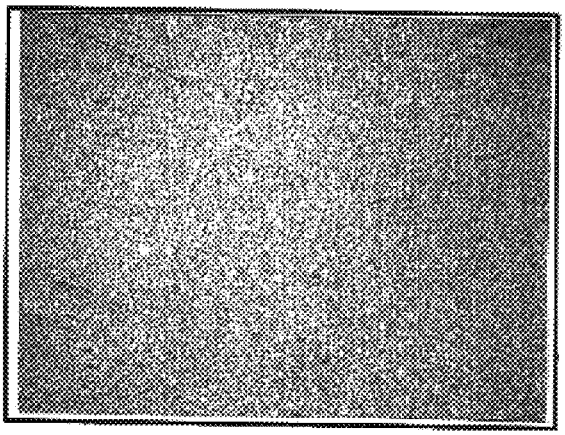
Figure 7A:
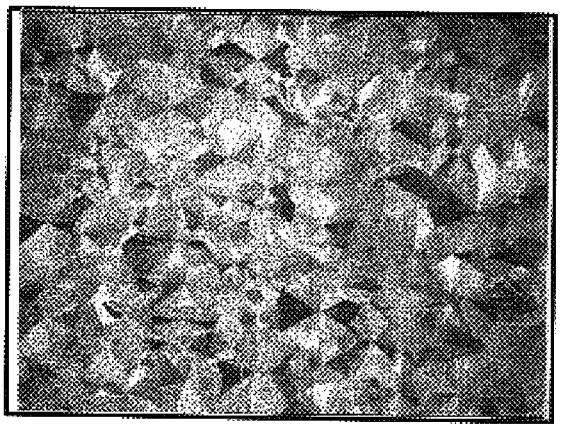
FIGS. 7*a*–7*c* are photomicrographs showing spangle facet size for a conventionally coated product with and without titanium.
Figure 7B:
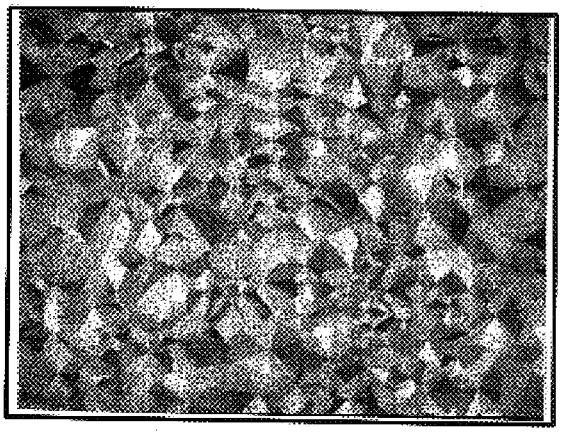
Figure 7C:
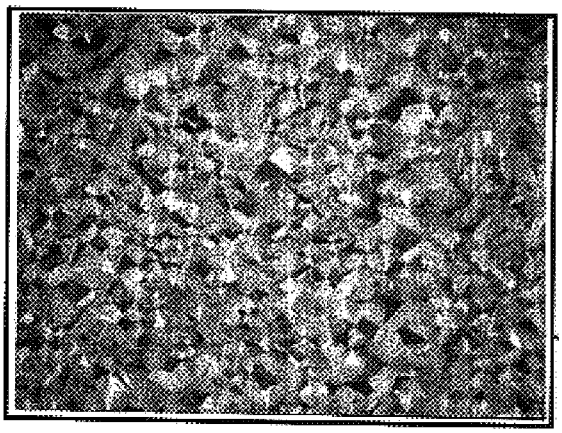
Figure 8A:
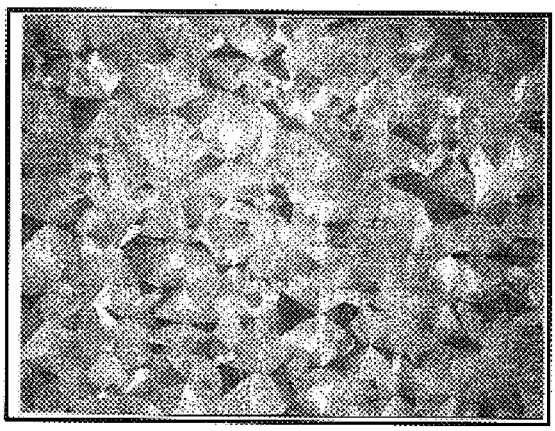
FIGS. 8*a*–8*c* are photomicrographs showing spangle facet size for a conventionally coated product and a TiC-modified product.
Figure 8B:
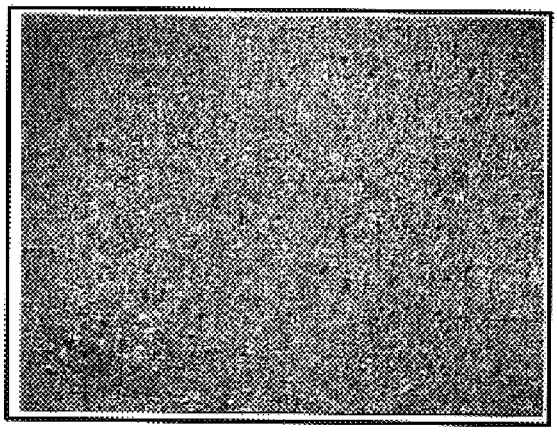
Figure 8C:
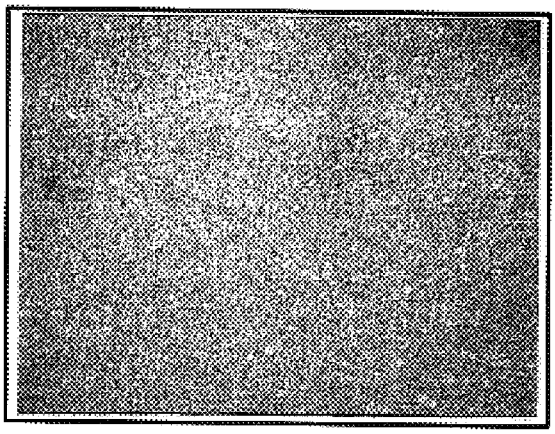
Figure 9A:
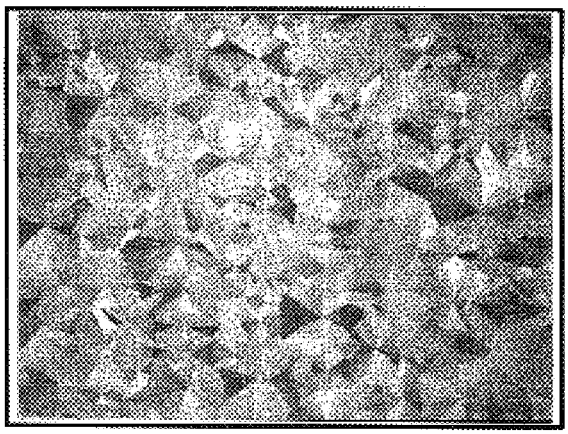
FIGS. 9*a*–9*c* are photomicrographs showing spangle facet size for a conventionally coated product and an $AlB_2$–$AlB_{12}$ modified product.
Figure 9B:
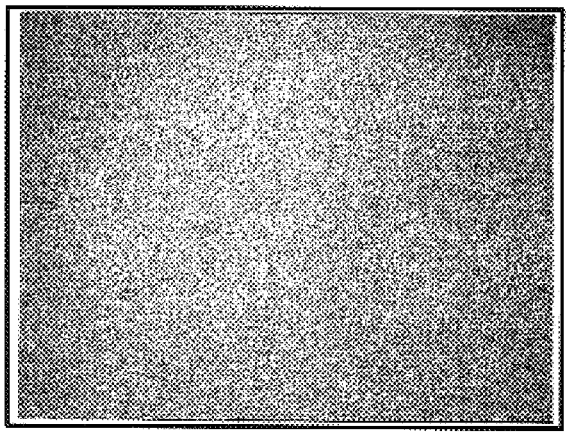
Figure 9C:
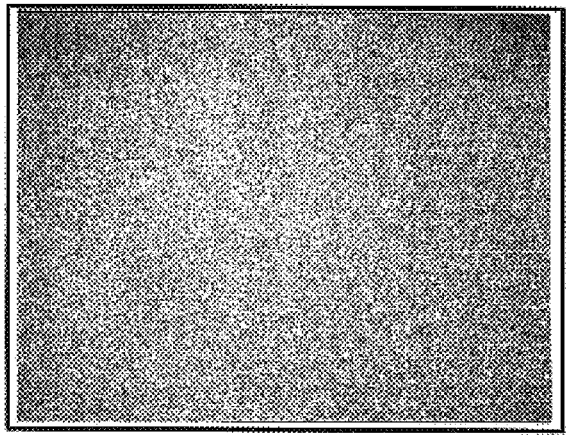

FIGS. 6A–9C compare the invention to the prior art and demonstrate the reduction in spangle facet size. FIGS. 6A–6C show the effect of $TiB_2$ added in the form of an Al-5%Ti-1%B master alloy, wherein a significant refinement of spangle facet size is achieved as compared to conventional Galvalume coatings. Similar reductions in spangle facet size are shown in FIGS. 8A–8C and 9A–9C when titanium carbide and aluminum borides are used as modifiers. Most importantly, when comparing FIGS. 6A–6C and FIGS. 7A–7C, particularly, FIGS. 6C and 7C, the addition of titanium alone does not produce the same spangle facet size reduction. In fact, the presence of titanium alone as compared to $TiB_2$ only marginally decreases spangle facet size.

If boride additions fall below a specific concentration range, the appearance of the spangle size in the hot-dip coating becomes non-uniform and inconsistent within the same coil as well as from coil to coil. On the other hand, when boride additions are greater than the specific range, spangle size is no longer visible to the naked eye. Additionally, at the lower boride concentration levels, below the specific range, the small additions to the hot-dip bath are difficult to measure and control, adding to the problem of inconsistency in spangle size.

In certain instances, visual spangle size is desirable in Galvalume like hot-dip coated products. Such visibly spangled products are widely used in large construction applications, for example, roofing and siding in large industrial and agricultural type structures. However, customers view inconsistent spangle size as a coating quality problem as well as an aesthetic problem. Variation in spangle size manifests itself as a non-uniform appearance from panel to panel on the roof or sides of a building, which in turn is objectionable to the building owner.

A more uniform, consistent spangle size may be produced by adding a small amount of TiB2 grain refiner to the hot-dip coating bath. By making bath additions of between about 0.0008–0.0012% by weight boron in the form of boride particles to the bath we are able to produce a consistent spangle facet size of between about 400 to 500 microns (measured using the mean intercept length method described in ASTM E112). Producers and customers consider such controlled spangle size products superior in visual appearance as compared to a conventional spangle aluminum-zinc coated products where boride additions fall outside the specified range.

As such, an invention has been disclosed in terms of preferred embodiments thereof which fulfills each and every one of the objects of the present invention as set forth above and provides new and improved coated steel product, a method of making and a coating composition therefore.

Of course, various changes, modifications, and alterations from the teachings of the present invention may be contemplated by those skilled in the art without departing from the intended spirit and scope thereof. It is intended that the present invention only be limited by the terms of the appended claims.

I claim:

1. In a method of coating a steel product using a molten aluminum-zinc alloy bath, the improvement comprising modifying the composition of the aluminum-zinc alloy by adding an effective amount of one or more of a particulate compound constituent that produces a coated spangle size on a substrate of between about 400 to 500 microns, said grain refining particulate compound selected from the group consisting of boride compounds in an amount between about 0.0008 to 0.0012% by weight, and having one of titanium and aluminum.

2. The method of claim 1, wherein the particulate compound constitute is one of $TiB_2$, $AlB_2$, and $AlB_{12}$.

3. The method of claim 1, wherein a particle size of the particulate compound constituent ranges between about 0.01 microns and about 25 microns.

4. The method of claim 2, wherein a particle size of the particulate compound constituent ranges between about 0.01 microns and about 25 microns.

5. The method of claim 1, further comprising the step of making a master alloy bath of aluminum and adding an amount of the particulate compound constituents thereto, and then adding the master alloy bath to an aluminum-zinc coating bath in proportions to attain the effective amount of the particulate compound constituent.

6. In a coated steel article comprising a steel substrate; and an aluminum-zinc coating thereon, the improvement comprising the aluminum-zinc coating being modified with an effective amount of one or more of a particulate compound constituent selected from the group consisting of boride compounds having one of titanium and aluminum so that said aluminum-zinc coating has a spangle size of between about 400 to 500 microns.

7. The article of claim 6, wherein said aluminum-zinc coating is modified with said boride compounds in an amount between about 0.0008–0.0012% by weight.

8. The article of claim 7, wherein the particulate compound constituent is one of $TiB_2$, $AlB_2$, and $AlB_{12}$.

9. The article of claim 7, wherein a particle size of the particulate compound constituent in the coating ranges between about 0.01 microns and about 25 microns.

10. In an aluminum-zinc steel product coating composition capable of producing a coated steel substrate with a coating spangle size between about 400 to 500 microns, the improvement comprising an aluminum-zinc alloy including an effective amount of one or more of a particulate compound constituent selected from the group consisting of boride compounds in an amount between about 0.0008–0.0012% by weight, and having one of titanium and aluminum.

11. The composition of claim 10, wherein the particulate compound constituent is one of $TiB_2$, $AlB_2$, and $AlB_{12}$.

12. The composition of claim 10, wherein a particle size of the particulate compound constituent in the coating ranges from between about 0.01 microns and about 25 microns.

13. The composition of claim 10, wherein the particulate compound constituent is the boride compound and the amount of the particulate compound constituent in the alloy bath ranges between about 0.0008–0.0012% by weight of boron.

14. The method of claim 1, further comprising painting the coated steel product without subjecting the coated steel product to skin passing.

15. The article of claim 7, further comprising a painted surface on the coated steel product.

* * * * *